US011270636B2

(12) United States Patent
Shi

(10) Patent No.: US 11,270,636 B2
(45) Date of Patent: Mar. 8, 2022

(54) PIXEL CIRCUIT AND DRIVING METHOD

(71) Applicant: Shenzhen China Star Optoelectronics Semiconductor Display Technology Co., Ltd., Guangdong (CN)

(72) Inventor: Longqiang Shi, Shenzhen (CN)

(73) Assignee: SHENZHEN CHINA STAR OPTOELECTRONICS SEMICONDUCTOR DISPLAY TECHNOLOGY CO., LTD., Guangdong (CN)

( * ) Notice: Subject to any disclaimer, the term of this patent is extended or adjusted under 35 U.S.C. 154(b) by 321 days.

(21) Appl. No.: 16/626,746

(22) PCT Filed: Dec. 17, 2019

(86) PCT No.: PCT/CN2019/125908
§ 371 (c)(1),
(2) Date: Dec. 26, 2019

(87) PCT Pub. No.: WO2021/109237
PCT Pub. Date: Jun. 10, 2021

(65) Prior Publication Data

US 2021/0335228 A1 Oct. 28, 2021

(30) Foreign Application Priority Data

Dec. 6, 2019 (CN) ..... 201911243249.4

(51) Int. Cl.
*G09G 3/3225* (2016.01)

(52) U.S. Cl.
CPC ... *G09G 3/3225* (2013.01); *G09G 2300/0819* (2013.01); *G09G 2300/0842* (2013.01); *G09G 2320/045* (2013.01)

(58) Field of Classification Search
CPC ..... G09G 3/32; G09G 3/3225; G09G 3/36
See application file for complete search history.

(56) References Cited

U.S. PATENT DOCUMENTS

2005/0105031 A1 5/2005 Shih et al.
2008/0043005 A1* 2/2008 Kanda ..... G09G 3/3233 345/204
2011/0063275 A1 3/2011 Imamura et al.
(Continued)

FOREIGN PATENT DOCUMENTS

CN 101266752 A 9/2008
CN 104078005 A 10/2014
(Continued)

*Primary Examiner* — Alexander Eisen
*Assistant Examiner* — Cory A Almeida
(74) *Attorney, Agent, or Firm* — Benesch, Friedlander, Coplan & Aronoff LLP

(57) ABSTRACT

A pixel circuit and a driving method are provided. The pixel circuit includes a switching transistor, a driving transistor, a storage capacitor, a light emitting device, and a reset module. The reset module is configured to output a reset signal to a gate of the driving transistor according to a reset control signal in a reset signal writing and reset stage, to neutralize bias stress on the driving transistor in a data signal writing and light emitting stage. This suppresses further drift of a threshold voltage and ensures stability of light emitting brightness of a light emitting device.

18 Claims, 6 Drawing Sheets

(56) References Cited

U.S. PATENT DOCUMENTS

| | | | |
|---|---|---|---|
| 2015/0029238 | A1 | 1/2015 | Kanda et al. |
| 2015/0103060 | A1 | 4/2015 | Yamashita et al. |
| 2015/0154941 | A1 | 6/2015 | Kanda et al. |
| 2016/0253958 | A1 | 9/2016 | Ma |
| 2017/0243542 | A1 | 8/2017 | Xiang et al. |
| 2018/0308407 | A1 | 10/2018 | Shi |
| 2020/0234650 | A1 | 7/2020 | Zhu et al. |

FOREIGN PATENT DOCUMENTS

| | | | | |
|---|---|---|---|---|
| CN | 104637446 | A | | 5/2015 |
| CN | 106448560 | A | | 2/2017 |
| CN | 106898290 | A | | 6/2017 |
| CN | 104637446 | B | * | 10/2017 |
| CN | 109147676 | A | | 1/2019 |
| CN | 110047432 | A | | 7/2019 |
| JP | 2005004173 | A | | 1/2005 |
| TW | 200516331 | A | | 5/2005 |

* cited by examiner

PIXEL CIRCUIT AND DRIVING METHOD

CROSS-REFERENCE TO RELATED APPLICATION

This application claims the priority of Chinese Application No. 201911243249.4 filed on Dec. 6, 2019 and titled "PIXEL CIRCUIT AND DRIVING METHOD", which is incorporated herein by reference in its entirety.

FIELD OF INVENTION

The present disclosure relates to the field of display technologies, and more particularly to a pixel circuit and a driving method.

BACKGROUND OF INVENTION

The research of sub-millimeter light emitting diodes (mini light emitting diodes, Mini-LEDs) as backlight sources for display devices is in the ascendant, and their display effects are comparable to organic light emitting diodes (OLEDs), and they have a great cost advantage.

As shown in FIG. 1A, which is a circuit diagram of a conventional Mini-LED pixel circuit. The pixel circuit shown in FIG. 1A is composed of a switching thin film transistor T1, a driving thin film transistor T2, and a storage capacitor Cst. A gate of the switching thin film transistor T1 is connected to a scan line, a first pole of the switching thin film transistor T1 is connected to a data line, and a second pole of the switching thin film transistor T1 is connected to a gate of the driving thin film transistor T2. One pole of a light emitting device, Mini-LED, is connected to a direct current (DC) high power supply VDD, and another pole of the light emitting device, Mini-LED, is connected to a first pole of the driving thin film transistor T2. A second pole of the driving thin film transistor T2 is connected to a DC low power source VSS. One end of the storage capacitor Cst is connected to the gate of the driving thin film transistor T2, and another end of the storage capacitor Cst is connected to the second pole of the driving thin film transistor T2.

FIG. 1B is a working timing diagram of the pixel circuit provided in FIG. 1A. A scan signal Scan (n) is an alternating current having a pulse width equal to H. A data signal Data (n) is an alternating current having a pulse width smaller than H. Data_H indicates a high potential. Data_L indicates a low potential. G (n) is an important node waveform. The dotted line indicates the working timing diagram under ideal working conditions. The solid line shows the working timing diagram in the actual working state. The working principle is as follows. In one refresh period (1 frame), when Scan (n) is at a high potential, the switching thin film transistor T1 is turned on, and the high potential Data_n of Data (n) is written to the gate of the driving thin film transistor T2. G (n) is the high potential Data_H. When Scan (n) is at a low potential, the switching thin film transistor T1 is turned off, and G (n) maintains a high potential Data_H.

For the driving thin film transistor T2 in FIG. 1A, its gate voltage will be subject to forward bias stress (PBTS) of Data_H for a long time. A subthreshold swing (Vth) of the driving thin film transistor T2 will drift forward, causing current flowing through the driving thin film transistor T2 to decrease. This promotes a reduction in brightness of the light emitting device, Mini-LED. In order to ensure stability of the brightness, the Mini-LED must solve the issues of Vth drift caused by the forward bias of the driving thin film transistor T2.

SUMMARY OF INVENTION

Embodiments of the present application provide a pixel circuit and a driving method, which can neutralize bias stress on a driving transistor in a data signal writing and light emitting stage, suppress a threshold voltage drift, and ensure stability of light emission of a light emitting device.

In a first aspect, an embodiment of the present application provides a pixel circuit, comprising a light emitting device, a driving transistor, a switching transistor, a storage capacitor, and a reset module; wherein a pole of the light emitting device is connected to a first common voltage terminal, and another pole of the light emitting device is connected to a first pole of the driving transistor; wherein a gate of the switching transistor is connected to a scan line, a first pole of the switching transistor is connected to a data line, the switching transistor is configured to write a data signal to a gate of the driving transistor in a data signal writing and light emitting stage; wherein a second pole of the driving transistor is connected to a second common voltage terminal, the gate of the driving transistor is connected to a second pole of the switching transistor, the driving transistor is configured to drive the light emitting device to emit light according to the data signal in the data signal writing and light emitting stage; wherein an end of the storage capacitor is connected to the gate of the driving transistor, and another end of the storage capacitor is connected to the second common voltage terminal; wherein the reset module is connected to a reset control signal, a reset signal, and the gate of the driving transistor, the reset module is configured to output the reset signal to the gate of the driving transistor according to the reset control signal in a reset signal writing and reset stage, such that the gate of the driving transistor is at a predetermined reset potential, and the predetermined reset potential has the same magnitude and opposite polarity as a potential written to the gate of the driving transistor in the data signal writing and light emitting stage.

In the pixel circuit, the reset module comprises a first transistor, a gate of the first transistor is connected to the reset control signal, a first pole of the first transistor is connected to the reset signal, and a second pole of the first transistor is connected to the gate of the driving transistor.

In the pixel circuit, the reset module further comprises a second transistor, a gate of the second transistor is connected to the data line, a first pole of the second transistor is connected to the reset signal, and a second pole of the second transistor is connected to the first pole of the first transistor.

In the pixel circuit, the reset module further comprises an inverter, an input terminal of the inverter is connected to the data line, an output terminal of the inverter is connected to the first pole of the second transistor, and the inverter is configured to output the reset signal according to the data signal input from the data line.

In the pixel circuit, the inverter comprises a load transistor and an input transistor, wherein a first pole of the load transistor is connected to a gate of the load transistor and a high-level signal, a second pole of the load transistor is connected to a first pole of the input transistor and the first pole of the second transistor; wherein a gate of the input transistor is connected to the data line, and a second pole of the input transistor is connected to the reset signal.

In the pixel circuit, the switching transistor, the driving transistor, the first transistor, the second transistor, the input transistor, and the load transistor are selected from one of a thin film transistor and a field effect transistor.

In the pixel circuit, the switching transistor, the driving transistor, the first transistor, the second transistor, the input transistor, and the load transistor are all thin film transistors of N-type transistors.

In the pixel circuit, the data signal writing and light emitting stage comprises a data signal writing stage and a light emitting stage, the reset signal is a constant signal, and the reset signal is negative 2 times the data signal in the data signal writing stage.

In the pixel circuit, a time duration corresponding to the data signal writing and light emitting stage is equal to a time duration corresponding to the reset signal writing and reset stage.

In the pixel circuit, a time duration corresponding to the data signal writing and light emitting stage is ½ a time duration of a refresh cycle, and a time duration corresponding to the reset signal writing and reset stage is ½ the time duration of the refresh cycle.

In the pixel circuit, the light emitting device is a light emitting diode.

In the pixel circuit, the light emitting device is at least one of a sub-millimeter light emitting diode, a micro light emitting diode, and an organic light emitting diode.

In the pixel circuit, the first common voltage terminal is a direct current (DC) high power source, and the second common voltage terminal is a DC low power source.

In a second aspect, an embodiment of the present application further provides a pixel driving method for driving the pixel circuit, wherein the pixel driving method comprises that: in the data signal writing and light emitting stage, a scan signal loaded by the scan line controls the switching transistor to be turned on first to write the data signal loaded by the data line to the gate of the driving transistor, the storage capacitor maintains the gate of the driving transistor at a predetermined potential, and the driving transistor drives the light emitting device to emit light; in the reset signal writing and reset stage, the reset module outputs the reset signal to the gate of the driving transistor according to the reset control signal, the storage capacitor maintains the gate of the driving transistor at a predetermined reset potential, to neutralize bias stress on the driving transistor in the data signal writing and light emitting stage.

In the pixel driving method, the scan signal and the data signal have the same frequency and the same phase, and pulse widths when the scan signal and the data signal are valid are equal, and the pulse widths range from 0.8 μs to 15 μs.

In the pixel driving method, a frequency of the scan signal is 120 Hz or 240 Hz.

In the pixel driving method, the predetermined potential and the predetermined reset potential have the same amplitude and opposite phases.

In the pixel driving method, the reset control signal and the scan signal have the same frequency, and a phase of the reset control signal lags a phase of the scan signal by 180°.

Beneficial effects of the present application are that: compared to the prior art, a pixel circuit and a driving method of embodiments of the present application are provided. The pixel circuit includes a switching transistor, a driving transistor, a storage capacitor, a light emitting device, and a reset module. The switching transistor is configured to write a data signal to a gate of the driving transistor in a data signal writing and light emitting stage, and the driving transistor drives the light emitting device to emit light according to the data signal. The reset module is configured to output a reset signal to the gate of the driving transistor according to a reset control signal in a reset signal writing and reset stage, to neutralize bias stress on the driving transistor in the data signal writing and light emitting stage. In the embodiment of the present application, the reset module is provided, so that the bias stress on the driving transistor in the data signal writing and light emitting stage is neutralized. This suppresses further drift of a threshold voltage and ensures stability of light emitting brightness of a light emitting device.

DETAILED DESCRIPTION OF PREFERRED EMBODIMENTS

In order to make the purpose, technical solution, and effect of the present application clearer and more definite, the present application is further described in detail below with reference to the accompanying drawings and examples. It should be understood that the specific embodiments described herein are only used to explain the present application and are not used to limit the present application.

Figure 1A:
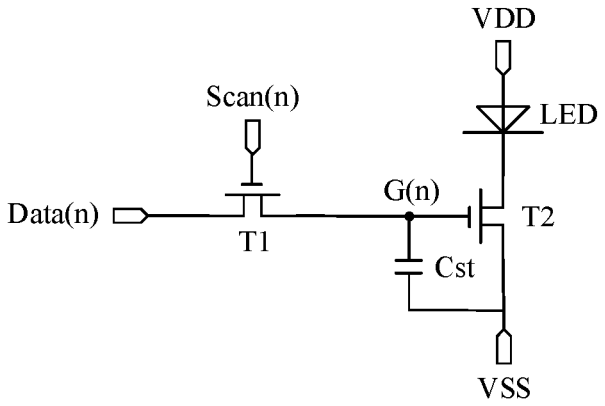
FIG. 1A is a circuit diagram of a conventional Mini-LED pixel circuit.
Figure 1B:
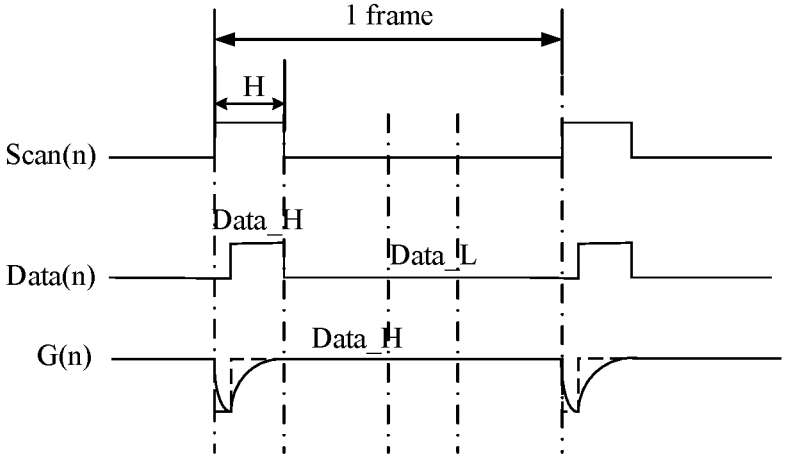
FIG. 1B is a working timing diagram of the pixel circuit provided in FIG. 1A.
Figure 2A:
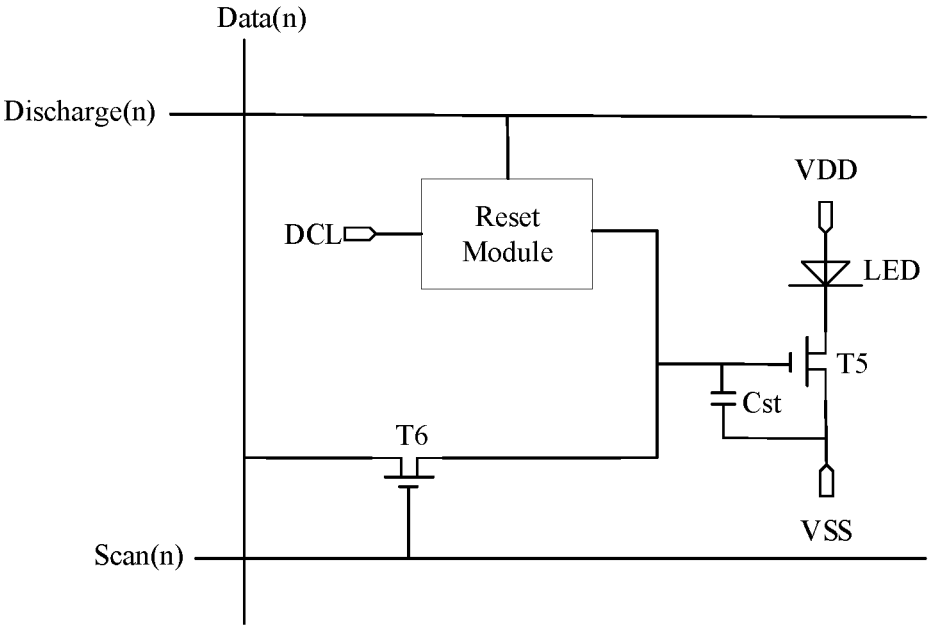
FIG. 2A is a schematic structural diagram of a first pixel circuit according to an embodiment of the present application.

Specifically, referring to FIG. 2A, which is a schematic diagram of a first pixel circuit structure according to an embodiment of the present application. The pixel circuit comprises a light emitting device LED, a driving transistor T5, a switching transistor T6, a storage capacitor Cst, and a reset module.

A pole of the light emitting device LED is connected to a first common voltage terminal VDD, and another pole of the light emitting device LED is connected to a first pole of the driving transistor T5.

A gate of the switching transistor T6 is connected to a scan line Scan(n), a first pole of the switching transistor T6 is connected to a data line Data(n), the switching transistor T6 is configured to write a data signal to a gate of the driving transistor T5 in a data signal writing and light emitting stage.

A second pole of the driving transistor T5 is connected to a second common voltage terminal VSS, the gate of the driving transistor T5 is connected to a second pole of the switching transistor T6, the driving transistor T5 is configured to drive the light emitting device LED to emit light according to the data signal in the data signal writing and light emitting stage.

An end of the storage capacitor Cst is connected to the gate of the driving transistor T5, and another end of the storage capacitor Cst is connected to the second common voltage terminal VSS.

The reset module is connected to a reset control signal Discharge(n), a reset signal DCL, and the gate of the driving transistor T5, the reset module is configured to output the reset signal DCL to the gate of the driving transistor T5 according to the reset control signal Discharge(n) in a reset signal writing and reset stage, such that the gate of the driving transistor T5 is at a predetermined reset potential, and the predetermined reset potential has the same magnitude and opposite polarity as a potential written to the gate of the driving transistor T5 in the data signal writing and light emitting stage.

In the pixel circuit provided in an embodiment of the present application, the reset module is provided, so that the bias stress on the driving transistor T5 in the data signal writing and light emitting stage is neutralized. This suppresses further drift of a threshold voltage and ensures stability of light emitting brightness of a light emitting device.

The first common voltage terminal VDD is a high DC power source, and the second common voltage terminal VSS is a low DC power source.

The light emitting device LED is a light emitting diode. Specifically, the light emitting diode is a sub-millimeter light emitting diode (Mini-LED), a micro light emitting diode (Micro-LED), or an organic light emitting diode (OLED).

In an embodiment of the present application, a plurality of the light emitting devices LED adopt a common anode connection method. Specifically, referring to FIG. 2A, an anode of the light emitting device LED is connected to the first common voltage terminal VDD. A cathode of the light emitting device LED is connected to the first pole of the driving transistor T5.

In addition, a plurality of the light emitting devices LED may also adopt a common cathode connection method. Specifically, an anode of the light emitting device is connected to the second pole of the driving transistor T5. A cathode of the light emitting device LED is connected to the second common voltage terminal VSS. Since a common cathode connection method and a common anode connection method adopted by a plurality of the light emitting devices LED are similar, details are not described in the embodiments of the present application.

The transistors used in the embodiments of the present application include a thin film transistor or a field effect transistor. In order to distinguish a source and a drain in a transistor other than a gate. A first pole of the present application may be one of a drain and a source, and accordingly, a second pole may be another one of a source and a drain.

An embodiment of the present application further provides a pixel driving method for driving the pixel circuit, wherein the pixel driving method comprises that:

In the data signal writing and light emitting stage, a scan signal loaded by the scan line Scan(n) controls the switching transistor T6 to be turned on first to write the data signal loaded by the data line Data(n) to the gate of the driving transistor T5, the storage capacitor Cst maintains the gate of the driving transistor T5 at a predetermined potential, and the driving transistor drives the light emitting device LED to emit light.

In the reset signal writing and reset stage, the reset module outputs the reset signal DCL to the gate of the driving transistor T5 according to the reset control signal Discharge (n), the storage capacitor Cst maintains the gate of the driving transistor T5 at a predetermined reset potential, to neutralize bias stress on the driving transistor T5 in the data signal writing and light emitting stage.

Figure 2B:
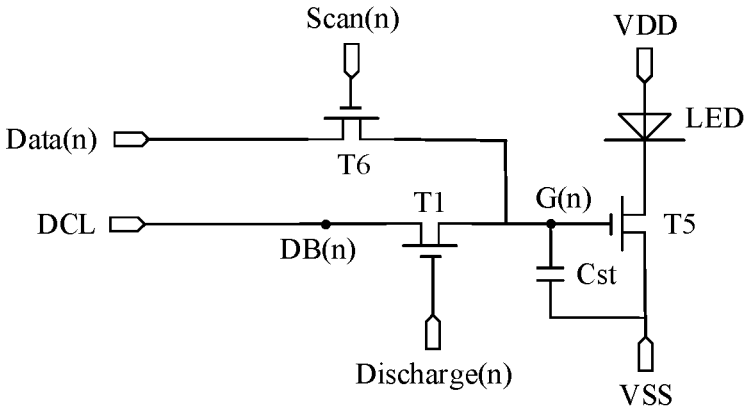
FIG. 2B is a circuit diagram of a first pixel circuit according to a specific embodiment of the present application.

Referring to FIG. 2B, which is a circuit diagram of a first pixel circuit according to a specific embodiment of the present application. The reset module includes a first transistor T1. A gate of the first transistor T1 is connected to the reset control signal Discharge (n), a first pole of the first transistor T1 is connected to the reset signal DCL, and a second pole of the first transistor T1 is connected to the gate of the driving transistor T5.

Figure 2C:
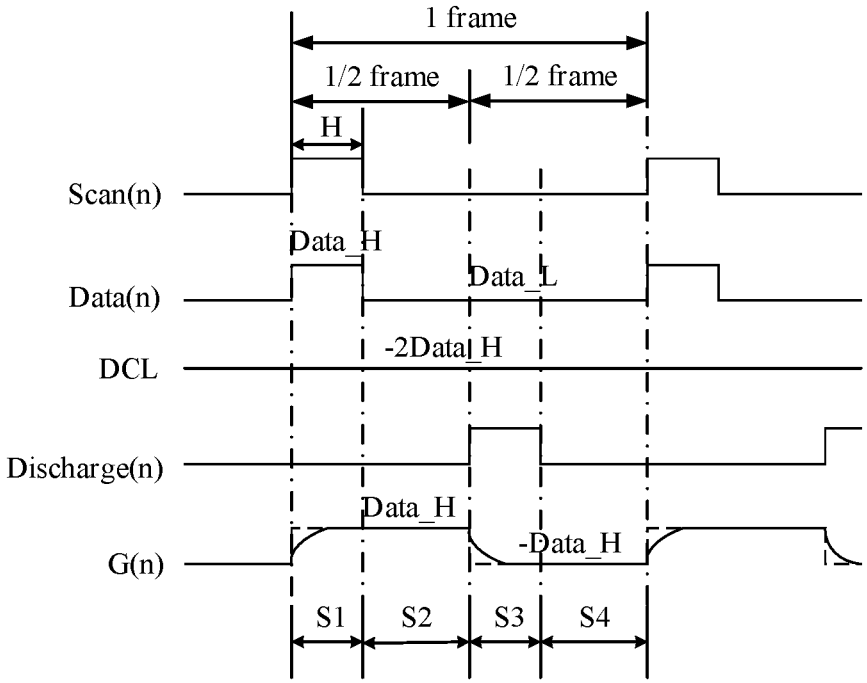
FIG. 2C is a working timing diagram of the first pixel circuit provided in FIG. 2B.

Referring to FIG. 2C, which is a working timing diagram of the first pixel circuit provided in FIG. 2B. In each refresh cycle (1 frame), it includes two stages, which are a data signal writing and light emitting stage and a reset signal writing and reset stage.

First stage: The data signal writing and light emitting stage includes a data signal writing stage S1 and a light emitting stage S2. That is:

Data signal writing stage S1: When the scan signal on the scan line Scan (n) is at a high level, the switching transistor T6 is turned on. A gate of the driving transistor T5 writes a data signal Data_H through the data line Data (n). That is, a node G (n) writes the data signal Data_H. However, due to existence of the storage capacitor Cst, it takes a period of time for the potential of the node G (n) to reach Data_H. Specifically, the storage capacitor Cst is charged by the data signal Data_H on the data line Data (n). The potential of the node G (n) continuously rises to a predetermined potential Data_H. When a voltage between the gate and the second pole of the driving transistor T5 is greater than a threshold voltage of the driving transistor T5, the driving transistor T5 is turned on to drive the light emitting device LED to emit light.

Light emitting stage S2: When the scan signal on the scan line Scan (n) is at a low level, the switching transistor T6 is turned off, and the storage capacitor Cst stops being charged. The driving transistor T5 is maintained on by using the storage capacitor Cst, the light emitting device LED continues to emit light, and the gate of the driving transistor T5 is subjected to a forward bias stress.

The reset control signal Discharge (n) is at a low level in the data signal writing stage S1 and the light emitting stage S2, the first transistor T1 is turned off, and the potential of the node DB (n) is written into the reset signal DCL.

The reset signal DCL is a constant signal, and the reset signal DCL is negative 2 times of the data signal in the data signal writing stage, that is, DCL=−2Data_H.

Second phase: the reset signal writing and reset stage includes a reset signal writing stage S3 and a reset stage S4. That is:

Reset signal writing stage S3: when the reset control signal Discharge (n) is at a high level, the scan signal on the scan line Scan (n) is at a low level. The switching transistor T6 is kept off, the first transistor T1 is turned on, and the gate of the driving transistor T5 is written with the reset signal DCL. That is, the node G (n) writes the reset signal DCL. However, due to the existence of the storage capacitor Cst, it takes a period of time for the potential of the node G (n) to reach the predetermined reset potential −Data_H. Specifically, the storage capacitor Cst is charged by the reset signal DCL. The potential of the node G (n) gradually changes from the predetermined potential Data_H to a predetermined reset potential −Data_H. That is G (n)=−2Data_H+Data_H=−Data_H. When the voltage between the gate and the second pole of the driving transistor T5 is less than the threshold voltage of the driving transistor T5, the driving transistor T5 is turned off, and the light emitting device LED stops emitting light.

Reset stage S4: When the reset control signal Discharge (n) is at a low level, the first transistor T1 is turned off, and the storage capacitor Cst stops charging. The storage capacitor Cst maintains the gate of the driving transistor T5 at a predetermined reset potential −Data_H. At this time, the gate of the driving transistor T5 is subjected to a negative bias stress and turns off when the scan signal on the scan line Scan (n) is at a high level in the next refresh period.

In order to make the negative bias stress that the driving transistor T5 receives during the reset signal writing and reset stage can completely neutralize the forward bias stress that the driving transistor T5 receives during the data signal writing and light emitting stage. A time duration corresponding to the data signal writing and light emitting stage is equal to a time duration corresponding to the reset signal writing and reset stage, that is, the time duration corresponding to the data signal writing and light emitting stage is ½ frame; the time duration corresponding to the reset signal writing and reset stage is ½ frame.

In details, the reset control signal Discharge(n) and the scan signal have the same frequency, and a phase of the reset control signal Discharge(n) lags a phase of the scan signal by 180°.

In order to avoid that the light emitting device LED stops emitting light during the reset signal writing and reset stage to affect the display effect, a frequency of the scan signal is 120 Hz or 240 Hz. The scan signal and the data signal have the same frequency and the same phase, and pulse widths when the scan signal and the data signal are valid are equal, and the pulse widths range from 0.8 μs to 15 μs.

Figure 3A:
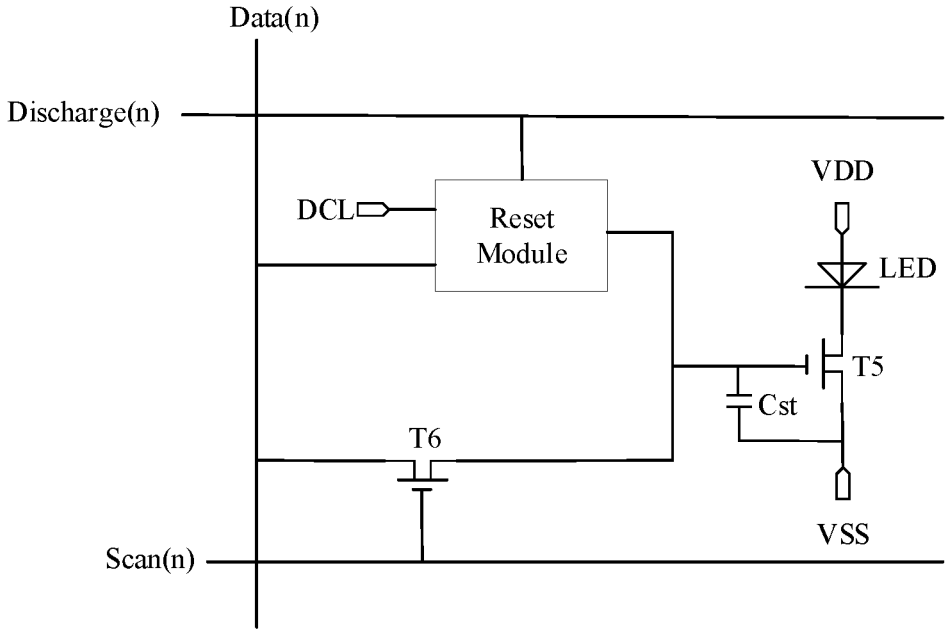
FIG. 3A is a schematic diagram of a second pixel circuit structure according to an embodiment of the present application.

Referring to FIG. 3A, which is a schematic diagram of a second pixel circuit structure according to an embodiment of the present application. The reset module locks the reset signal DCL using a data signal loaded on the data line Data (n). This prevents the reset signal DCL from changing and affects a normal operation of the pixel circuit.

Figure 3B:
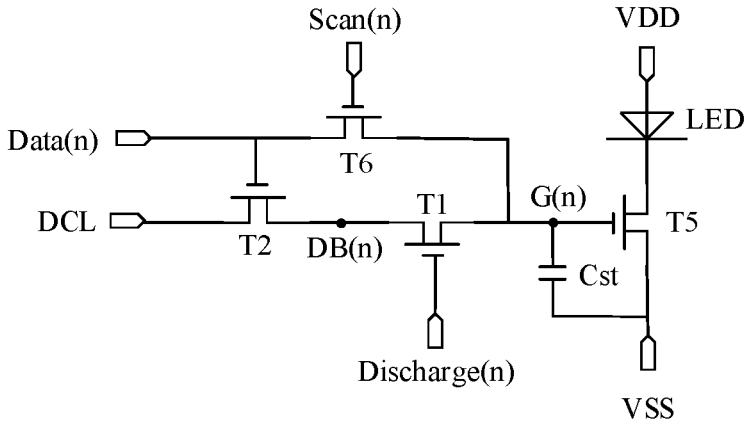
FIG. 3B is a circuit diagram of a second pixel circuit according to a specific embodiment of the present application.

Referring to FIG. 3B, which is a circuit diagram of a second pixel circuit according to a specific embodiment of the present application. The reset module further includes a second transistor T2. A gate of the second transistor T2 is connected to the data line Data (n). A first pole of the second transistor T2 is connected to the reset signal DCL. A second pole of the second transistor T2 is connected to a first pole of the first transistor T1.

Figure 3C:
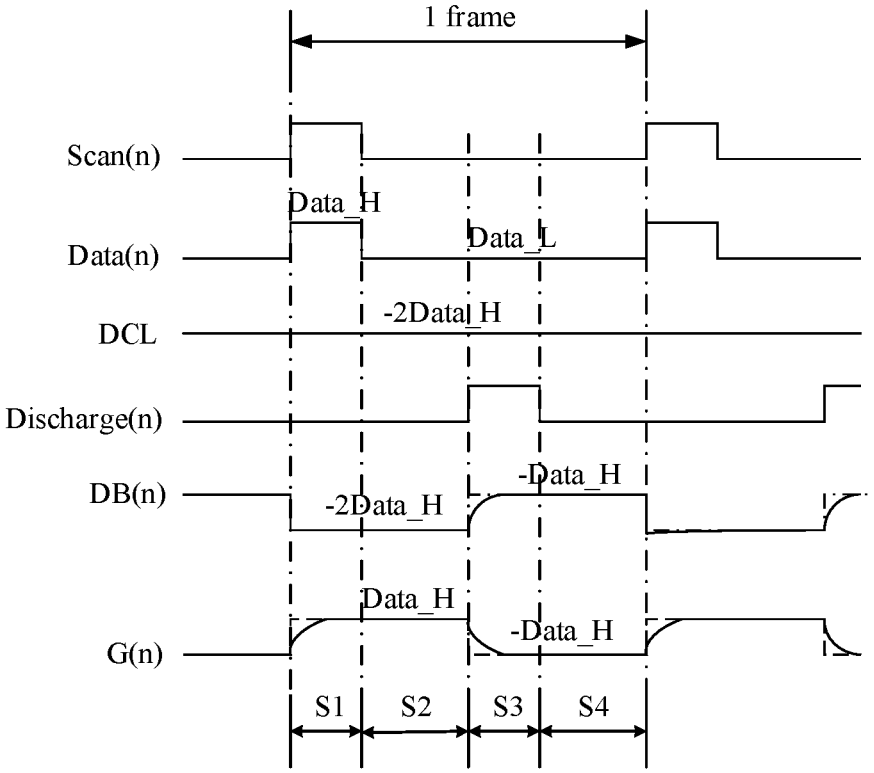
FIG. 3C is a working timing diagram of the second pixel circuit provided in FIG. 3B.

Referring to FIG. 3C, which is a working timing diagram of the second pixel circuit provided in FIG. 3B. In each refresh cycle (1 frame), it includes two stages, which are a data signal writing and light emitting stage and a reset signal writing and reset stage.

First stage: The data signal writing and light emitting stage includes a data signal writing stage S1 and a light emitting stage S2. That is:

Data signal writing stage S1: When the scan signal on the scan line Scan (n) is at a high level and the data signal on the data line Data (n) is at a high level Data_H, the switching transistor T6 and the second transistor T2 are turned on. A first pole of the first transistor T1 is written into the reset signal DCL. That is, the potential of the node DB (n) is −2Data_H. The storage capacitor Cst is charged by the data signal Data_H on the data line Data (n). The potential of the node G (n) continuously rises to a predetermined potential Data_H. When the voltage between the gate and the second electrode of the driving transistor T5 is greater than the threshold voltage of the driving transistor T5, the driving transistor T5 is turned on to drive the light emitting device LED to emit light.

Light emitting stage S2: When the scan signal on the scan line Scan (n) is at a low level and the data signal on the data line Data (n) is at a low level Data_L, the switching transistor T6 and the second transistor T2 are turned off. The storage capacitor Cst stops being charged. The driving transistor T5 is maintained on by using the storage capacitor Cst. The light emitting device LED continues to emit light, and the gate of the driving transistor T5 is subjected to a forward bias stress.

The reset control signal Discharge (n) is at a low level in the data signal writing stage S1 and the light emitting stage S2, the first transistor T1 is turned off, and the potential of the node DB (n) is maintained at −2Data_H.

Second phase: the reset signal writing and reset stage includes a reset signal writing stage S3 and a reset stage S4. That is:

Reset signal writing stage S3: When the reset control signal Discharge (n) is at a high level, the scan signal on the scan line Scan (n) is at a low level, and the data signal on the data line Data (n) is at a low level Data_L. The switching transistor T6 and the second transistor T2 are kept off, and the first transistor T1 is turned on. The potential of the node DB (n) and the potential of the node G (n) are neutralized and gradually become a predetermined reset potential −Data_H. That is, the potential of the node DB (n) gradually changes from −2Data_H to the predetermined reset potential −Data_H. The potential of the node G (n) gradually changes from the predetermined potential Data_H to a predetermined reset potential −Data_H. That is G (n)=−2Data_H+Data_H=−Data_H. When the voltage between the gate and the second electrode of the driving transistor T5 is less than the threshold voltage of the driving transistor T5, the driving transistor T5 is turned off, and the light emitting device LED stops emitting light.

Reset stage S4: When the reset control signal Discharge (n) is at a low level, the first transistor T1 is turned off. The storage capacitor Cst maintains the gate of the driving transistor T5 at a predetermined reset potential −Data_H. At this time, the gate of the driving transistor T5 is subjected to a negative bias stress and turns off when the scanning signal on the scanning line Scan (n) is at a high level in the next refresh period.

The second transistor T2 may use a data signal on the data line Data (n) to control a first pole of the first transistor T1 to write the reset signal DCL in advance. This keeps the potential of the first pole of the first transistor T1 constant and increases controllability of the pixel circuit.

Figure 4A:
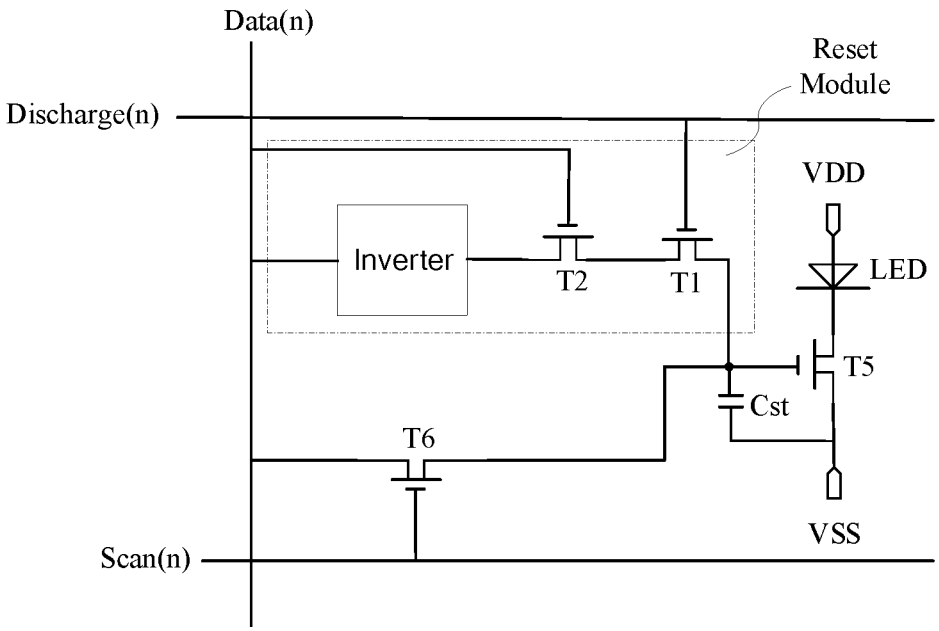
FIG. 4A is a schematic diagram of a third pixel circuit structure according to an embodiment of the present application.

Referring to FIG. 4A, which is a schematic diagram of a third pixel circuit structure according to a specific embodiment of the present application. The reset module further includes an inverter. An input terminal of the inverter is connected to the data line Data (n). An output terminal of the inverter is connected to a first pole of the second transistor T2. The inverter is configured to output a reset signal DCL according to the data signal input from the data line Data (n).

Figure 4B:
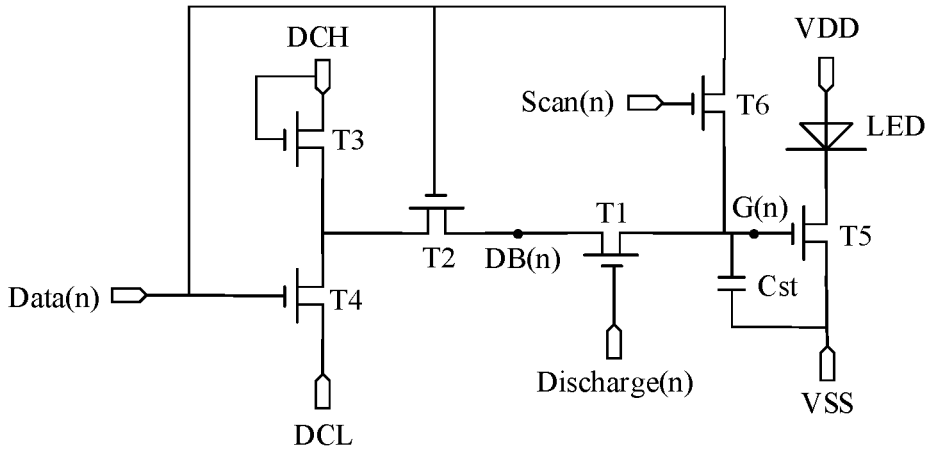
FIG. 4B is a circuit diagram of a third pixel circuit according to a specific embodiment of the present application.

Referring to FIG. 4B, which is a circuit diagram of a third pixel circuit according to a specific embodiment of the present application. The inverter includes a load transistor T3 and an input transistor T4.

A first pole of the load transistor T3 is connected to a gate of the load transistor T4 and a high level signal DCH. A second pole of the load transistor T3 is connected to a first pole of the input transistor T4 and the first pole of the second transistor T2.

A gate of the input transistor T4 is connected to the data line Data (n), and a second pole of the input transistor T4 is connected to the reset signal DCL.

Figure 4C:
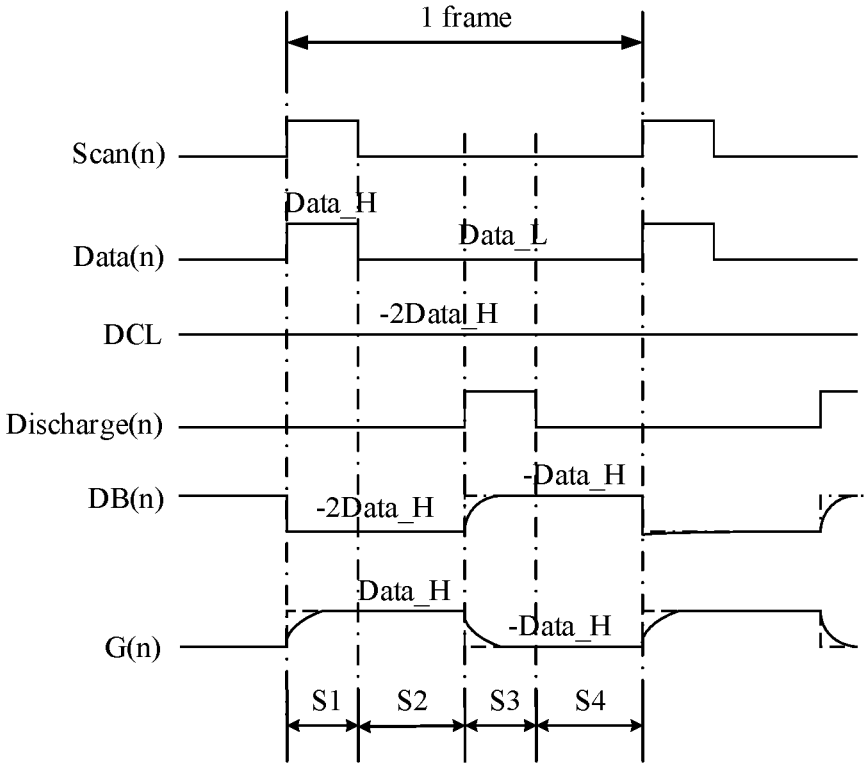
FIG. 4C is a working timing diagram of the third pixel circuit provided in FIG. 4B.

Referring to FIG. 4C, which is a working timing diagram of the third pixel circuit provided in FIG. 4B. In each refresh cycle (1 frame), it includes two stages, which are a data signal writing and light emitting stage and a reset signal writing and reset stage.

First stage: The data signal writing and light emitting stage includes a data signal writing stage S1 and a light emitting stage S2. That is:

Data signal writing stage S1: When the scan signal on the scan line Scan (n) is at a high level and the data signal on the data line Data (n) is at a high level Data_H, the switching transistor T6, the second transistor T2, and the input transistor T4 are turned on. A first pole of the first transistor T1 is written into the reset signal DCL. That is, the potential of the node DB (n) is −2Data_H. The storage capacitor Cst is charged by the data signal Data_H on the data line Data (n). The potential of the node G (n) continuously rises to a predetermined potential Data_H. When the voltage between the gate and the second electrode of the driving transistor T5 is greater than the threshold voltage of the driving transistor T5, the driving transistor T5 is turned on to drive the light emitting device LED to emit light.

Light emitting stage S2: When the scan signal on the scan line Scan (n) is at a low level and the data signal on the data line Data (n) is at a low level Data_L, the switching transistor T6, the second transistor T2, and the input transistor T4 are turned off. The load transistor T3 is turned on. The first pole of the second transistor T2 is written with a high-level signal DCH. The potential of the node DB (n) is maintained at −2Data_H. The storage capacitor Cst stops being charged. The driving transistor T5 is maintained on by using the storage capacitor Cst. The light emitting device LED continues to emit light. The gate of the driving transistor T5 is subjected to a forward bias stress. The high-level signal DCH is minus two times the data signal during the light emitting stage, that is, DCH=−2Data_L.

The reset control signal Discharge (n) is at a low level in the data signal writing stage S1 and the light emitting stage S2, the first transistor T1 is turned off, and the potential of the node DB (n) is maintained at −2Data_H.

Second phase: the reset signal writing and reset stage includes a reset signal writing stage S3 and a reset stage S4. That is:

Reset signal writing stage S3: When the reset control signal Discharge (n) is at a high level, the scan signal on the scan line Scan (n) is at a low level, and the data signal on the data line Data (n) is at a low level Data_L, the switching transistor T6, the second transistor T2, and the input transistor T4 are kept off. The first transistor T1 is turned on. The potential of the node DB (n) and the potential of the node G (n) are neutralized and gradually become a predetermined reset potential −Data_H. That is, the potential of the node DB (n) gradually changes from −2Data_H to the predetermined reset potential −Data_H. The potential of the node G (n) gradually changes from the predetermined potential Data_H to a predetermined reset potential −Data_H. That is G (n)=−2Data_H+Data_H=−Data_H. When the voltage between the gate and the second electrode of the driving transistor T5 is less than the threshold voltage of the driving transistor T5, the driving transistor T5 is turned off, and the light emitting device LED stops emitting light.

Reset stage S4: When the reset control signal Discharge (n) is at a low level, the first transistor T1 is turned off. The storage capacitor Cst maintains the gate of the driving transistor T5 at a predetermined reset potential −Data_H. At this time, the gate of the driving transistor T5 is subjected to a negative bias stress and turns off when the scan signal on the scan line Scan (n) is at a high level in the next refresh period.

The inverter may output a signal having a phase opposite to that of the data signal. This ensures that the signal written into the first pole of the first transistor T1 is always opposite to the phase of the data signal written by the driving transistor T5 in the data signal writing and light emitting stage. This ensures that the bias stress that the driving transistor T5 receives during the reset signal writing and reset stage is opposite to the bias stress that the driving transistor T5 receives during the data signal writing and light emitting stage. This suppresses the drift of the threshold voltage and ensures the stability of light emission.

Referring to FIG. 2C, FIG. 3C, and FIG. 4C, in an ideal state, the working timing of DB (n) and G (n) is shown as a dotted line. However, in an actual work, because of the storage capacitor Cst, the actual working timing of DB (n) and G (n) is shown as a solid line.

In the pixel circuits in the embodiments of the present application, N-type transistors are used for description. Those skilled in the art may also replace N-type transistors with P-type transistors, and correspondingly invert the phase of the signal to obtain an analysis result. That is, when a N-type transistor is replaced with a P-type transistor, a state when each signal is high is replaced with a state when low, and a state when each signal is low is replaced with a state when high. This can realize the function of suppressing the drift of the threshold voltage and improving the stability of light emission. Therefore, in this embodiment of the present application, the pixel circuit using the P-type transistor and the driving method thereof will not be described in detail.

In the above embodiments, the description of each embodiment has its own emphasis. For a part that is not described in detail in an embodiment, reference may be made to related descriptions in other embodiments.

The pixel circuit and the driving method thereof provided in the embodiments of the present application have been described in detail above. Specific examples are used herein to explain the principles and implementation of the present application. The description of the above embodiments is only used to help understand the technical solutions of the present application and its core ideas. Those of ordinary skill in the art should understand that they can still modify the technical solutions described in the foregoing embodiments or replace some of the technical features equivalently. These modifications or replacements do not make the essence of the corresponding technical solutions outside the scope of the technical solutions of the embodiments of the present application.

What is claimed is:

1. A pixel circuit, comprising:

a light emitting device, a driving transistor, a switching transistor, a storage capacitor, and a reset module;

wherein a pole of the light emitting device is connected to a first common voltage terminal, and another pole of the light emitting device is connected to a first pole of the driving transistor;

wherein a gate of the switching transistor is connected to a scan line, a first pole of the switching transistor is connected to a data line, the switching transistor is configured to write a data signal to a gate of the driving transistor in a data signal writing and light emitting stage;

wherein a second pole of the driving transistor is connected to a second common voltage terminal, the gate of the driving transistor is connected to a second pole of the switching transistor, the driving transistor is configured to drive the light emitting device to emit light according to the data signal in the data signal writing and light emitting stage;

wherein an end of the storage capacitor is connected to the gate of the driving transistor, and another end of the storage capacitor is connected to the second common voltage terminal;

wherein the reset module is connected to a reset control signal, a reset signal, and the gate of the driving transistor, the reset module is configured to output the reset signal to the gate of the driving transistor according to the reset control signal in a reset signal writing and reset stage, such that the gate of the driving transistor is at a predetermined reset potential, and the predetermined reset potential has the same magnitude and opposite polarity as a potential written to the gate of the driving transistor in the data signal writing and light emitting stage.

2. The pixel circuit according to claim 1, wherein the reset module comprises a first transistor, a gate of the first transistor is connected to the reset control signal, a first pole of the first transistor is connected to the reset signal, and a second pole of the first transistor is connected to the gate of the driving transistor.

3. The pixel circuit according to claim 2, wherein the reset module further comprises a second transistor, a gate of the second transistor is connected to the data line, a first pole of the second transistor is connected to the reset signal, and a second pole of the second transistor is connected to the first pole of the first transistor.

4. The pixel circuit according to claim 3, wherein the reset module further comprises an inverter, an input terminal of the inverter is connected to the data line, an output terminal of the inverter is connected to the first pole of the second transistor, and the inverter is configured to output the reset signal according to the data signal input from the data line.

5. The pixel circuit according to claim 4, wherein the inverter comprises a load transistor and an input transistor, wherein a first pole of the load transistor is connected to a gate of the load transistor and a high-level signal, a second pole of the load transistor is connected to a first pole of the input transistor and the first pole of the second transistor;

wherein a gate of the input transistor is connected to the data line, and a second pole of the input transistor is connected to the reset signal.

6. The pixel circuit according to claim 5, wherein the switching transistor, the driving transistor, the first transistor, the second transistor, the input transistor, and the load transistor are selected from one of a thin film transistor and a field effect transistor.

7. The pixel circuit according to claim 6, wherein the switching transistor, the driving transistor, the first transistor, the second transistor, the input transistor, and the load transistor are all thin film transistors of N-type transistors.

8. The pixel circuit according to claim 1, wherein the data signal writing and light emitting stage comprises a data signal writing stage and a light emitting stage, the reset signal is a constant signal, and the reset signal is negative 2 times the data signal in the data signal writing stage.

9. The pixel circuit according to claim 1, wherein a time duration corresponding to the data signal writing and light emitting stage is equal to a time duration corresponding to the reset signal writing and reset stage.

10. The pixel circuit according to claim 9, wherein a time duration corresponding to the data signal writing and light emitting stage is ½ a time duration of a refresh cycle, and a time duration corresponding to the reset signal writing and reset stage is ½ the time duration of the refresh cycle.

11. The pixel circuit according to claim 1, wherein the light emitting device is a light emitting diode.

12. The pixel circuit according to claim 11, wherein the light emitting device is at least one of a sub-millimeter light emitting diode, a micro light emitting diode, and an organic light emitting diode.

13. The pixel circuit according to claim 1, wherein the first common voltage terminal is a direct current (DC) high power source, and the second common voltage terminal is a DC low power source.

14. A pixel driving method for driving the pixel circuit according to claim 1, wherein the pixel driving method comprises that:

in the data signal writing and light emitting stage, a scan signal loaded by the scan line controls the switching transistor to be turned on first to write the data signal loaded by the data line to the gate of the driving transistor, the storage capacitor maintains the gate of the driving transistor at a predetermined potential, and the driving transistor drives the light emitting device to emit light;

in the reset signal writing and reset stage, the reset module outputs the reset signal to the gate of the driving transistor according to the reset control signal, the storage capacitor maintains the gate of the driving transistor at a predetermined reset potential, to neutralize bias stress on the driving transistor in the data signal writing and light emitting stage.

15. The pixel driving method according to claim 14, wherein the scan signal and the data signal have the same frequency and the same phase, and pulse widths when the scan signal and the data signal are valid are equal, and the pulse widths range from 0.8 μs to 15 μs.

16. The pixel driving method according to claim 15, wherein a frequency of the scan signal is 120 Hz or 240 Hz.

17. The pixel driving method according to claim 14, wherein the predetermined potential and the predetermined reset potential have the same amplitude and opposite phases.

18. The pixel driving method according to claim 14, wherein the reset control signal and the scan signal have the same frequency, and a phase of the reset control signal lags a phase of the scan signal by 180°.

* * * * *